US006029877A

United States Patent [19]

Woods

[11] Patent Number: 6,029,877

[45] Date of Patent: Feb. 29, 2000

[54] RUCKSACK

[76] Inventor: Andrew L Woods, 50 Cairn Hill, Foxrock, Dublin 18, Ireland

[21] Appl. No.: 09/127,898

[22] Filed: Aug. 3, 1998

[30] Foreign Application Priority Data

Oct. 13, 1997 [IE] Ireland ..... 970740

[51] Int. Cl.[7] ..... A45F 3/04

[52] U.S. Cl. ..... 224/652; 224/236; 224/656

[58] Field of Search ..... 224/652, 655, 224/656, 236, 580, 153; 383/2

[56] References Cited

U.S. PATENT DOCUMENTS

| | | | |
|---|---|---|---|
| 2,729,257 | 1/1956 | Kepper | 383/2 |
| 4,177,909 | 12/1979 | Haskell | 224/153 |
| 4,609,084 | 9/1986 | Thomas | 224/153 |
| 4,648,121 | 3/1987 | Lowe | 224/652 |
| 4,883,207 | 11/1989 | McArthur | 224/153 |
| 4,884,731 | 12/1989 | Sibley | 224/651 |
| 4,887,751 | 12/1989 | Lehman | 224/151 |
| 4,940,173 | 7/1990 | Jacober | 224/153 |
| 5,012,964 | 5/1991 | Falletta et al. | 224/652 |
| 5,409,152 | 4/1995 | Trevino | 224/652 |
| 5,567,055 | 10/1996 | Smith | 383/38 |
| 5,680,973 | 10/1997 | Vulpitta et al. | 224/153 |
| 5,718,104 | 2/1998 | Kennedy | 224/236 |

FOREIGN PATENT DOCUMENTS

| | | | |
|---|---|---|---|
| 167038 | 10/1950 | Austria | 224/209 |
| 0199853 | 11/1986 | European Pat. Off. . | |
| 1119394 | 6/1956 | France | 383/2 |
| 58618 | 11/1937 | Norway | 224/8 |
| 1234267 | 6/1971 | United Kingdom | 224/209 |

*Primary Examiner*—Stephen P. Garbe

*Attorney, Agent, or Firm*—Jacobson, Price, Holman & Stern, PLLC

[57] ABSTRACT

A rucksack (1) for carrying a radio set has a bag (2) with a cover flap (3) and shoulder straps mounted on a rear wall of the bag (2). A removable pouch (5) for carrying a radio set is mounted within the bag (2) on a rear wall of the bag (2). The removable pouch (5) is preferably secured to the rear wall of the bag (2) by means of quick-release spring clips (17). These allow different pouches (5) carrying different radios to be quickly and easily mounted within the rucksack (1) as required. The cover (3) has a pair of slits (24, 25) extending inwardly from each side of the cover (3) for through passage of an aerial and a handset cable when a radio set is mounted in the pouch (5) and the cover (3) is closed.

18 Claims, 3 Drawing Sheets

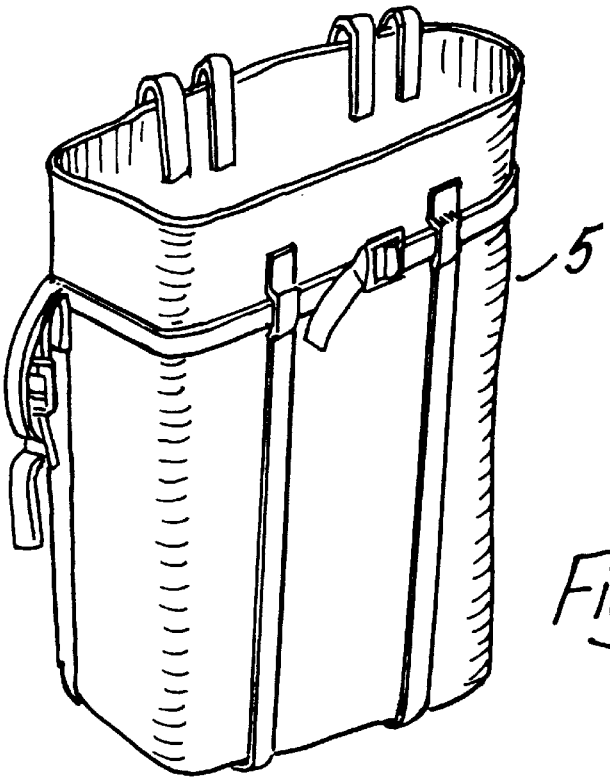
Fig.3
Fig.4
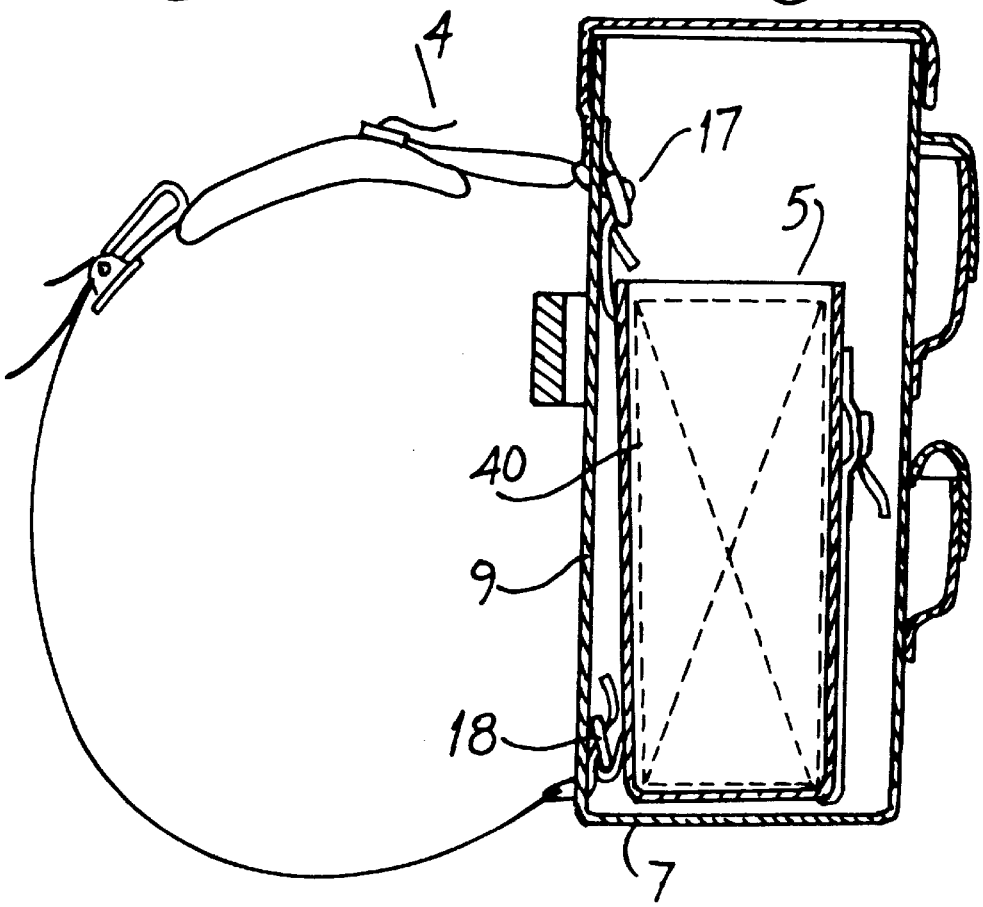

RUCKSACK

This invention relates to a rucksack or back-pack for carrying a radio set.

The invention is particularly concerned with rucksacks of the type used by the military in the signal corps for carrying radio equipment. It is known to provide such rucksacks with an internal pocket to receive a radio. A drawback of this arrangement is that the rucksack is dedicated to a particular radio set and therefore different rucksacks must be provided for use with the different radio sets. This is somewhat inconvenient for the users as the rucksacks are not interchangeable and they have to stock a number of different types of rucksack. There is also considerable expense involved in purchasing a number of different types of rucksack to accommodate different radio types.

The present invention is directed towards overcoming this problem.

Patent Specification U.S. Pat. No. 5,567,055 discloses a lashing system for attachment of components to a bag, suitcase, back-pack or the like. The lashing system comprises plastic loops attached to the bag and associated straps on the component for engagement with the loops. Patent Specification U.S. Pat. No. 4,177,909 discloses a convertible purse having several components which may all be carried within the purse but which may also be used individually.

According to the invention, there is provided a rucksack for carrying a radio set comprising a bag having a base panel with side walls extending upwardly from the base defining a mouth at an upper rim of the side walls with a cover flap hingedly attached at an upper end of the side walls for extension over the mouth of the bag to close the bag, shoulder straps mounted on a rear wall of the bag, a radio pouch mounted within the bag, the radio pouch being adapted to receive an associated radio set, the radio pouch being removably mounted at a rear side wall of the bag by releasable fastener means engagable between the pouch and the bag. Advantageously, as the pouch is removable, different radio sets can be carried in the same rucksack using a variety of different pouches which are adapted for mounting the different radios within the rucksack.

In a particularly preferred embodiment, one or more slits are provided in the cover flap of the rucksack above the radio pouch for through passage of an aerial and a handset cable of a radio which extend through the cover in use.

Conveniently, the removable pouch is suspended within the bag on a rear wall of the bag. The pouch may be removably mounted to the rear wall by any suitable means such as by clips, especially quick release clips, ties or slide fasteners or the like. Quick release grips are particularly suitable as a combined good strength, which is necessary for supporting radio equipment, with speed and ease of mounting or removing the pouch from the bag of the rucksack.

In another embodiment means is provided for collapsing the bag of the rucksack to a smaller size which is convenient if only the radio equipment is to be carried in the rucksack. Said means may conveniently comprise two-part slide fasteners with the two parts of the slide fasteners being spaced-apart on the side wall of the bag so that the side wall can be folded together in a pleat to collapse the side wall.

In a further embodiment, the collapsing means comprises one or more pairs of straps mounted on a side wall of the bag, each pair of straps being releasably interengagable to fold the side wall in a pleat to collapse the side wall. Preferably, each pair of straps are interengagable by means of quick release clips.

Also, conveniently additional removable pockets may be mounted on an exterior of the rucksack for carrying equipment. The pockets may incorporate slide fastener parts which are engagable with the slide fastener parts on the bag to secure the pockets to the bag. Thus a selection of different pockets may be provided for carrying different pieces of equipment if desired. Also load carrying capacity of the rucksack can be easily increased where necessary.

In a further embodiment an aerial pouch is mounted on an exterior of the bag for carrying an aerial when not in use.

Preferably the material of the rucksack is selected to give protection against infra-red night visibility.

The invention will be more clearly understood by the following description of some embodiments thereof, given by way of example only, with reference to the accompanying drawings, in which;

FIG. 3 is a perspective view of a removable pouch for the rucksack; and

FIG. 4 is a side sectional elevational view of the rucksack.

Figure 1:
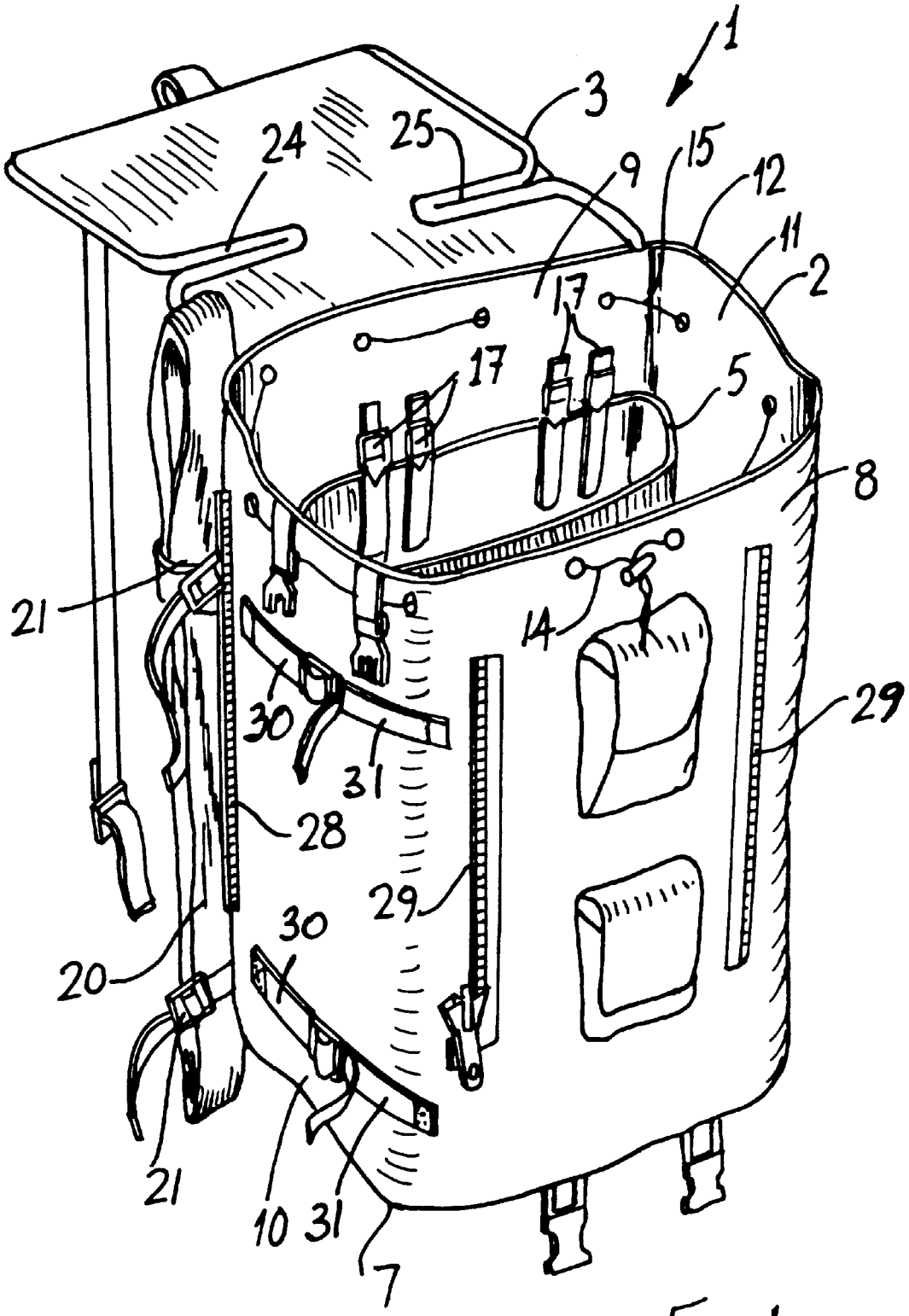
FIG. 1 is a perspective view of a rucksack according to the invention.
Figure 2:
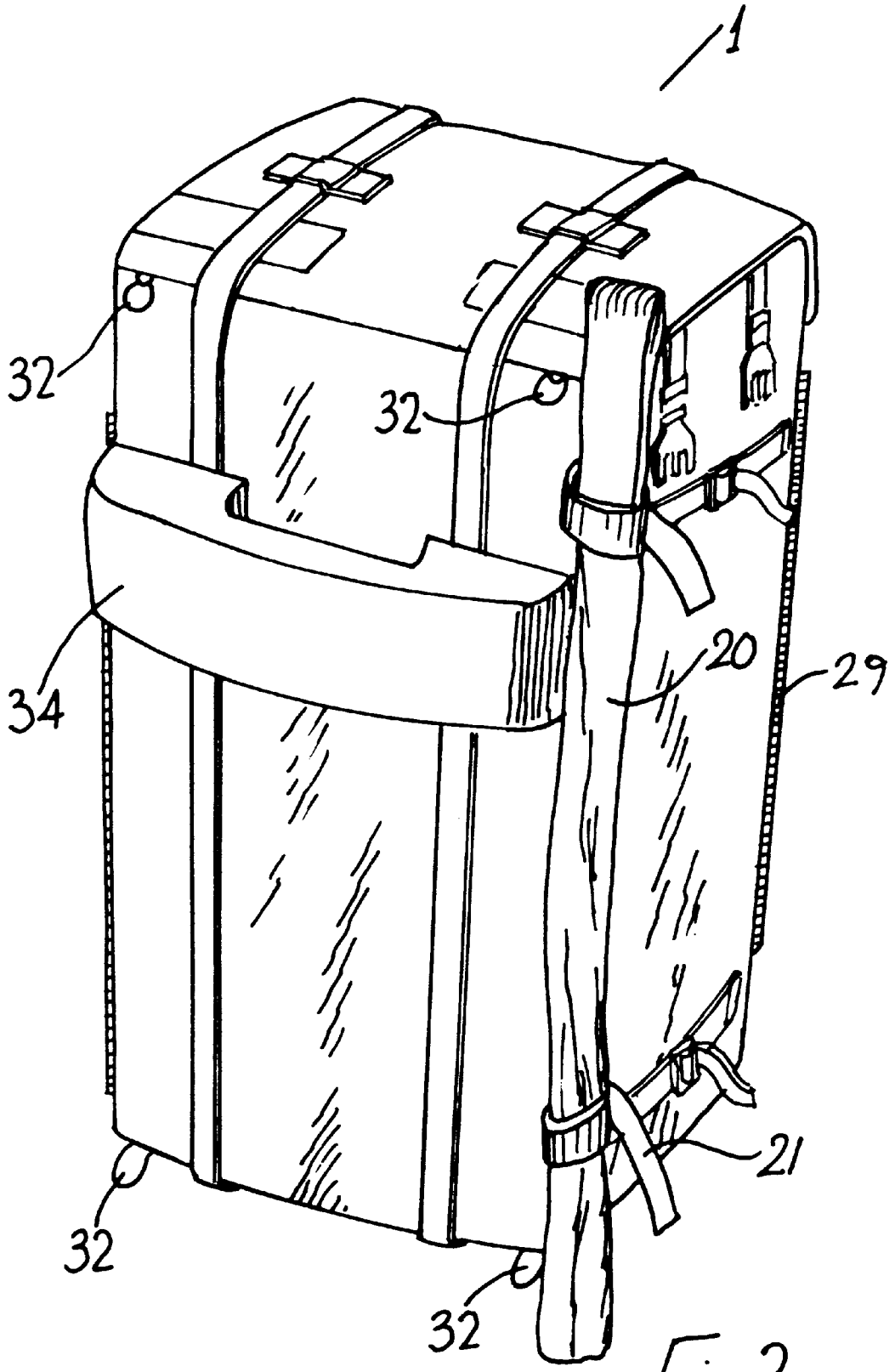
FIG. 2 is a rear perspective view of the rucksack.

Referring to the drawings, there is illustrated a rucksack according to the invention indicated generally by the reference numeral 1. The rucksack 1 has a bag 2 with a cover flap 3 and shoulder straps 4. Mounted within the bag 2 is a removable pouch 5 for carrying an associated radio set shown in broken outline in FIG. 4.

The bag 2 has a generally rectangular base panel 7. A front wall 8, rear wall 9 and side walls 10, 11 extend upwardly from the base 7. Upper ends of the walls 8, 9, 10, 11 form a rim 12 which is closable by a drawstring 14. The rim 12 defines a mouth 15 of the bag 2 for packing and unpacking the bag 2.

The pouch 5 is suspended at an upper end of the rear wall 9 in this case by quick-release spring clips 17. One part of each spring clip 17 is fixed to a reinforced panel at an upper end of the rear wall 9 and the other part of each spring clip is attached to an upper end of the pouch 5. In this case four quick-release spring clips 17 are provided. A clip 18 secures a lower end of the pouch 5 to a bottom of the rear wall 9.

An aerial pouch 20 is mounted by straps 21 at one side of the rear wall 9.

The cover 3 has a pair of slits 24, 25 extending inwardly from each side of the cover 3 for through passage of an aerial and a handset cable when a radio set is mounted in the pouch 5 and the cover 3 is closed.

At each side of the bag 2 on each of the side walls 10, 11 a pair of parts 28, 29 of a slide fastener are mounted adjacent a rear and front of the side wall 10, 11. The side walls 10, 11 can be collapsed and the fastener parts 28, 29 engaged to collapse the bag 2 to a smaller size when it is not necessary to carry additional equipment other than the radio in the rucksack 1.

In this regard also, on each side wall 10, 11, there is provided upper and lower pairs of straps 30, 31 anchored adjacent the rear and the front of the bag 2 and extending generally horizontally therebetween. The straps of each pair of straps 30, 31 interengage by a buckle which may be of quick-release type so that the side wall 10, 11 can be reduced in size as required by pulling up one or both straps 30, 31 on the buckle.

It will be noted that when in the open position as shown in FIG. 1 the slide fastener parts 28, 29 can be used for mounting additional pockets on an exterior of the rucksack 1 for carrying extra equipment. Complementary slide fastener parts are provided on the add-on pockets.

The shoulder straps 4 are detachably engagable with associated loops 32 mounted at upper and lower ends of the rear wall 9 of the bag 2. Also provided on the rear wall 9 is a hanger 34 which is engagable with a carrying frame (not shown) which may be used to carry the rucksack 1 as an alternative to the shoulder straps 4.

In use, the rucksack 1 is carried in usual fashion by means of the shoulder straps 4 or by the use of a carrying frame which is engaged with the hanger 34 on the rear wall 9 of the rucksack 1. A radio 40 (FIG. 4) is mounted within the pouch 5 and the remainder of the bag 2 may be filled with clothing and other equipment. To change the radio 40 the clips 17, 18 are released and the pouch 5 can be removed from the bag 2 of the rucksack 1 and an alternative pouch and radio loaded in the bag 2 of the rucksack 1. Thus advantageously various different radio types may be securely carried within the rucksack 1. Changeover between the different radio types can be quickly and easily carried out.

The invention is not limited to the embodiments hereinbefore described which may be varied in both construction and detail.

I claim:

1. A rucksack for carrying a radio set comprising a bag having a base panel with side walls extending upwardly from the base defining a mouth at an upper rim of the side walls with a cover flap hingedly attached at an upper end of the side walls for extension over the mouth of the bag to close the bag, shoulder straps mounted on a rear wall of the bag, a radio pouch mounted within the bag, the radio pouch being adapted to receive an associated radio set, the radio pouch being removably mounted at a rear wall of the bag by releasable fastener means engagable between the pouch and the bag, one or more slits being provided in the cover flap of the rucksack above the pouch for through passage of an aerial and a handset cable of a radio which extend through the cover in use.

2. A rucksack as claimed in claim 1 wherein the pouch is removably mounted to the rear wall by quick release clips.

3. A rucksack as claimed in claim 1, wherein means is provided for collapsing the bag of the rucksack to a smaller size.

4. A rucksack as claimed in claim 3 wherein said means comprises two-part slide fasteners with the two parts of the slide fasteners being spaced-apart on the side wall of the bag so that the side wall can be folded in a pleat to collapse the side wall.

5. A rucksack as claimed in claim 3 wherein the collapsing means comprises a pair of straps mounted on a side wall of the bag, said pair of straps being releasably interengagable to fold the side wall in a pleat to collapse the side wall.

6. A rucksack as claimed in claim 4 wherein the straps are interengagable by means of quick release clips.

7. A rucksack as claimed in claim 1, wherein removable pockets are mounted on an exterior of the rucksack for carrying equipment.

8. A rucksack as claimed in claim 7, wherein the pockets incorporate slide fastener parts which are engagable with the slide fastener parts on the bag to secure the pockets to the bag.

9. A rucksack as claimed in claim 1, wherein an aerial pouch is mounted on an exterior of the bag for carrying an aerial when not in use.

10. A rucksack for carrying a radio set comprising a bag having a base panel with side walls extending upwardly from the base defining a mouth at an upper rim of the side walls with a cover flap hingedly attached at an upper end of the side walls for extension over the mouth of the bag to close the bag, a hanger mounted on a rear wall of the bag, said hanger being engagable with a carrying frame which may be used to carry the rucksack, a radio pouch mounted within the bag, the radio pouch being adapted to receive an associated radio set, the radio pouch being removably mounted at a rear wall of the bag by releasable fastener means engagable between the pouch and the bag, one or more slits being provided in the cover flap of the rucksack above the pouch for through passage of an aerial and a handset cable of a radio which extend through the cover in use.

11. A rucksack as claimed in claim 10, wherein the pouch is removably mounted to the rear wall by quick release clips.

12. A rucksack as claimed in claim 10, wherein means is provided for collapsing the bag of the rucksack to a smaller size.

13. A rucksack as claimed in claim 12, wherein said means comprises two-part slide fasteners with the two parts of the slide fasteners being spaced-apart on the side wall of the bag so that the side wall can be folded in a pleat to collapse the side wall.

14. A rucksack as claimed in claim 12, wherein the collapsing means comprises a pair of straps mounted on a side wall of the bag, said pair of straps being releasably interengagable to fold the side wall in a pleat to collapse the side wall.

15. A rucksack as claimed in claim 14, wherein the straps are interengagable by means of quick release clips.

16. A rucksack as claimed in claim 10, wherein removable pockets are mounted on an exterior of the rucksack for carrying equipment.

17. A rucksack as claimed in claim 16, wherein the pockets incorporate slide fastener parts which are engagable with the slide fastener parts on the bag to secure the pockets to the bag.

18. A rucksack as claimed in claim 10, wherein an aerial pouch is mounted on an exterior of the bag for carrying an aerial when not in use.

* * * * *